US005098029A

United States Patent [19]

McIntyre

[11] Patent Number: 5,098,029

[45] Date of Patent: Mar. 24, 1992

[54] APPARATUS AND METHOD FOR MINIMIZING WEB CINCHING DURING UNWINDING OF ROLLS OF WEB MATERIALS OF INDETERMINATE LENGTH

[75] Inventor: Dennis A. McIntyre, Rochester, N.Y.

[73] Assignee: Eastman Kodak Company, Rochester, N.Y.

[21] Appl. No.: 531,983

[22] Filed: Jun. 1, 1990

[51] Int. Cl.[5] ..... B65H 23/08

[52] U.S. Cl. ..... 242/75.44

[58] Field of Search ..... 242/75.4, 75.43, 75.44, 242/75.5, 75.51, 75.53, 184

[56] References Cited

U.S. PATENT DOCUMENTS

| | | | |
|---|---|---|---|
| 1,286,331 | 12/1918 | James . | |
| 3,249,316 | 5/1966 | Loase | 242/75.44 |
| 3,258,214 | 6/1966 | Comstock | 242/55.12 |
| 3,278,100 | 10/1966 | Hornberger | 226/189 |
| 3,330,457 | 7/1967 | Foster et al. | 242/75.43 |
| 3,414,208 | 12/1968 | Butler et al. | 242/58.1 |
| 3,669,375 | 6/1972 | Bruton | 242/75.4 |
| 3,672,596 | 6/1972 | Hoffmann | 242/75.43 |
| 3,811,637 | 5/1974 | Abler | 242/75.43 |
| 3,822,838 | 7/1974 | Butler et al. | 242/75.44 |
| 4,000,865 | 1/1977 | Gaskins | 242/75.43 |
| 4,407,331 | 10/1983 | Rehling et al. | 242/75.51 X |
| 4,411,393 | 10/1983 | Jodrey et al. | 242/75.43 |
| 4,437,619 | 3/1984 | Cary et al. | 242/75.51 |
| 4,474,321 | 10/1984 | Komoto et al. | 242/75.51 X |
| 4,793,564 | 12/1988 | Hank et al. | 242/75.44 |
| 4,838,498 | 6/1989 | Huth | 242/75.51 |
| 4,905,927 | 3/1990 | Lesse | 242/75.43 |
| 4,966,333 | 10/1990 | Bosch | 242/75.51 |

FOREIGN PATENT DOCUMENTS

| | | | |
|---|---|---|---|
| 931985 | 8/1973 | Canada | 242/75.4 |
| 252845 | 2/1990 | Japan | 242/75.44 |
| 551106 | 2/1943 | United Kingdom . | |
| 871759 | 6/1961 | United Kingdom . | |
| 995874 | 6/1965 | United Kingdom . | |
| 1020640 | 2/1966 | United Kingdom . | |
| 1088513 | 10/1967 | United Kingdom . | |
| 2185241 | 7/1987 | United Kingdom | 242/75.4 |

*Primary Examiner*—Daniel P. Stodola
*Assistant Examiner*—John P. Darling
*Attorney, Agent, or Firm*—Charles E. Snee, III

[57] ABSTRACT

An apparatus and method for minimizing web cinching during unwinding of rolls of web material of indeterminate length. The position of the float frame or support member (36) of an accumulator (32) for the web is monitored and a proportional signal is sent to a comparator (52) which produces an increasing output signal as the float frame opens in the accumulator and a decreasing signal as the float frame closes. The output signal is fed to an integrator (66) which produces a gradually increasing or decreasing contol signal for a voltage to pressure transducer (70) which operates a pneumatic brake (74).

8 Claims, 3 Drawing Sheets

APPARATUS AND METHOD FOR MINIMIZING WEB CINCHING DURING UNWINDING OF ROLLS OF WEB MATERIALS OF INDETERMINATE LENGTH

DESCRIPTION

1. Technical Field

This invention concerns apparatus and methods for unwinding rolls of web materials of indeterminate length. More particularly, the includes unique features for minimizing cinching of web material on its supply roll during unwinding.

2. Background Art

A known system for unwinding web materials of indeterminate length is illustrated in FIG. 1. Web material, such as photographic film, is wound on stock rolls 10,12 which are mounted for rotation with shafts 14,16. Electrically actuated brakes 18,20 are associated with the respective shafts for controlling their speeds of rotation. Indeterminate lengths 22,24 of web are drawn from stock rolls 10,12 and threaded past rollers 26, 28 to a means 30 for receiving and accumulating web, from which the web is withdrawn by a subsequent apparatus such as a spooler in the case of photographic film, not illustrated. The function of means 30 is to permit a temporary difference between the upstream and speeds of the web material coming from the s and leaving to the subsequent process apparatus, respectively. First, the web material from one stock is threaded through means 30 and the illustrated is operated until the stock roll is exhausted, a web material from the other stock roll is spliced to tail end of the web from the preceding stock roll and continues.

Means 30 comprises a substantially rectangular frame 32 on whose upper member is mounted at least one guide roller 34, though typically a plurality of such rollers are mounted in an essentially horizontal row as illustrated. Between the side members of frame 32 a support member 36, typically in the form of an elongate bar, is mounted slidably on a pair of parallel guide rods 38,40, which extend between the upper and lower members of frame 32. Support member 36 thus is permitted to move substantially vertically relative to frame 32, toward and away from the row of guide rollers 34. Support member 36 carries at least one further guide roller 42, though typically a plurality of such further rollers are mounted in an essentially horizontal row as illustrated. Web material 22,24 is threaded alternately over one of rollers 34, then under one of rollers 42 until all rollers are guiding the web, after which the web passes from means 30 to the subsequent process apparatus.

If the subsequent process apparatus is not demanding any web or is running at a web velocity lower than that of the web leaving the stock roll, support member 36 will fall within frame 32 due to gravity, thus drawing in more web and accumulating it until demand increases again. However, should support member 36 drop all the way to the lower member of frame 32, means 30 would become incapable of accepting more web, but the stock roll would continue to rotate and would spill web outside means 30. It is to prevent such an overrun condition that brakes 18,20 are provided in an attempt to control the unwinding of the stock rolls to prevent such a spill. On the other hand, if the subsequent process apparatus is running at a higher web velocity than the web leaving the stock roll, support member 36 will rise within frame 32. To permit this movement, the subsequent process apparatus continues to demand more web than the current stock roll speed will permit, due to continued braking or friction in the system, support member 36 may rise until it contacts the upper member of frame 32, a condition which may lead to breakage of the web.

As shown in FIG. 1, the known system includes a pair of limit switches 44,46 mounted on a side member of frame 32 where they can be actuated by support member 36 as it passes. The outputs of the limit switches are connected to a brake control 48 which applies or releases electrically actuated brakes 18,20 as a function of the vertical position of support member 36. In such a known mode of operation, movement of support member 36 above upper limit switch 44 causes brake control 48 to release the electrically actuated brake of the running stock roll, thus permitting the stock roll to accelerate to match the demand of the subsequent process apparatus. When support member 36 is above limit switch 44, the length of web material accumulated within means 30 should be sufficient to meet the largest anticipated demand from the subsequent process apparatus, without causing support member 36 to contact the upper member of frame 32. Later, when the demand drops, support member 36 falls below upper limit switch 44 which causes brake control 48 to apply the electrically actuated brake of the running stock roll, thus slowing the stock roll to a speed more closely matching demand. If support member 36 continues to fall and passes lower limit switch 46, brake control 48 applies the electrically actuated brake with a force known to be sufficient to stop the heaviest, fastest rotating stock roll before support member 36 reaches the lower member of frame 32.

In FIG. 2, the dot-dash line illustrates the application of brake force in the known system as a function of the position of support member 36, also known as the float frame. When support member 36 is above its upper limit, essentially no brake force is applied. When upper limit switch 44 is passed as support member 36 moves downward, control 48 initially sends a rather high voltage to the electrically actuated brakes to overcome their inertia, after which the voltage is reduced quickly to apply a medium range brake force. Should support member 36 continue to fall past limit switch 46, a higher voltage is applied to the electrically actuated brakes to ensure that the stock roll stops before support member 36 reaches the lower member of frame 32. This known mode of braking the stock rolls causes very rapid deceleration which can cause cinching of the material on the stock roll as the hub of the stock roll is braked more quickly than the web material departing the edge of the roll, particularly during the high voltage application required to overcome the inertia of electrically actuated brakes. This is particularly so for larger rolls where the unwinding force is applied at a larger diameter. Such cinching can cause undesirable scratching and other damage to the web material, particularly if photographic film is being unwound. Stock rolls are wound with a certain winding force or tension and may be quite tightly coiled or more loosely coiled when delivered to such an unwinding system. The tightness of the roll will determine how much torque the roll can transmit by friction among its convolutions, without further tightening or cinching. If an unwinding force is applied to the free end of a stationary or moving roll, the convolutions will tighten or cinch if the applied force causes the roll to transmit a torque greater than that which can be resisted by friction among its convolutions. If the medium brake force is reduced so that partially emptied rolls will not stop too quickly, then full rolls may not stop even when the high brake force is applied.

When the demand of the subsequent process apparatus increases, support member 36 rises and, when limit switch 46 is passed, the higher brake force is released. When limit switch 44 is passed, the medium brake force is released. The process then repeats until the stock roll is emptied. Another characteristic of electrically applied brakes that can create problems in the known system is their residual magnetism following release by control 48, which causes the brakes to remain partially applied even after support member 36 has moved above limit switch 44. This residual brake force can prevent the stock roll from accelerating to meet demand and may cause support member 36 to move into contact with the upper member of frame 32. Another difficulty with electrically actuated brakes is their tendency to change their response to voltage over time, thus leading to a need to recalibrate the system.

SUMMARY OF THE INVENTION

A primary object of this invention is to provide an apparatus and method for unwinding web material from a stock roll for delivery to a process apparatus, without causing cinching of the web material on the stock roll.

Another object of this invention is to provide such an apparatus and method which can be readily and inexpensively adapted to existing systems for unwinding web materials.

Still another object of the invention is to provide such an apparatus and method in which brake application and release can be precisely controlled without overshoot in applied brake force or residual brake force following release.

These objects are given only by way of illustrative examples; thus, other desirable objectives and advantages inherently achieved by the disclosed apparatus and method may occur or become apparent to those skilled in the art. Nonetheless, the scope of the invention is to be limited only by the appended claims.

In the apparatus and method according to the invention, a rotatable shaft is provided for a stock roll of web material of indeterminate length, along with means for braking rotation of such shaft. Web from the stock roll is directed to a means for receiving and accumulating a variable length of such web which comprises a frame; at least one guide roller supported by the frame; a support member; means for permitting the support member to move substantially vertically relative to the frame, toward and away from the at least one guide roller; and at least one further guide roller mounted on the support member. The web is threaded alternately around the at least one guide roller and the at least one further guide roller. Web is withdrawn from the means for receiving and accumulating by a subsequent process apparatus, such as a spooler in the case of photographic film. Means or a method step is provided for sensing the position of the support member relative to the frame and producing a signal. Means or a method step responsive to this signal applies the braking means with sufficient increasing brake force as the support member moves downward relative to the frame and releases the braking means with sufficient decreasing brake force as the support member moves upward relative to the frame, to maintain a desired level of tension in the web and to prevent cinching of the web on the stock roll. The brake force is increased or decreased, preferably, as the support member falls past or rises above, respectively, each of a plurality of levels during movement relative to the frame. Thus, no brake force is applied in a first, uppermost range of movement of the support member, but a gradually increasing brake force is applied as the support member moves downward through a second, lower range of movement until a preselected maximum brake force is reached for such second range of movement. The brake force is gradually increased in each range of movement beyond that for the preceding range of movement as the support member moves downward through successive, lower ranges of movement, until further preselected maximum brake forces are applied for each successive, lower range. As the support member rises relative to the frame into the next higher range of movement, the brake force is gradually decreased until the preselected maximum brake force of the next higher range of movement is reached; but the brake force is reduced to zero when the support member moves into the first, uppermost range of movement.

In the preferred embodiment of the invention, the means for braking is pneumatically actuated, to permit smoother application of the brakes. The signal from the means for sensing is directed to a comparator where it is compared to preset values corresponding to location of the support member within each of the ranges of movement and control signals are produced of increasing magnitude as the support member moves downward through the ranges of movement. The control signals are integrated for each range of movement to produce an actuation signal which is applied to a voltage to pressure transducer connected to the means for braking. Preferably, the control signal for each range of movement is added to the control signal for the preceding range of movement prior to integration. As the support member rises relative to the frame into the next higher range of movement, the actuation signal and the pressure applied to the brake decrease accordingly.

BRIEF DESCRIPTION OF THE DRAWINGS

The foregoing and other objects, features and advantages of the invention will be apparent from the following more particular description of the preferred embodiment of the invention, as illustrated in the accompanying drawings.

DESCRIPTION OF THE PREFERRED EMBODIMENT

Figure 1:
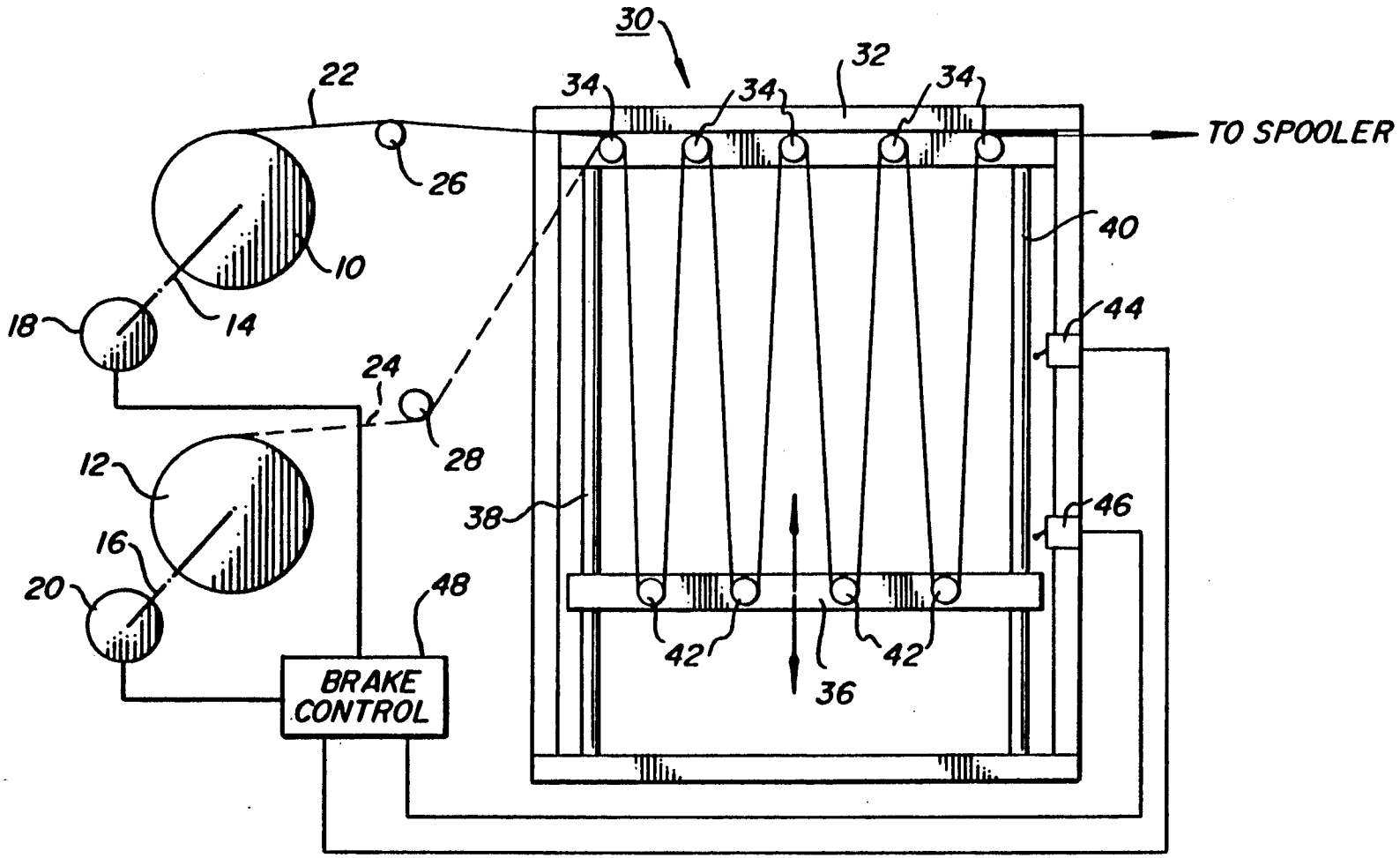
Fig. 1 PRIOR ART
FIG. 1 illustrates a prior art system for unwinding a stock roll of web material of indeterminate length.

The following is is a detailed description of the preferred embodiments of the invention, reference being made to the drawings in which the same reference numerals identify the same elements of structure in each of the several Figures.

Figure 2:
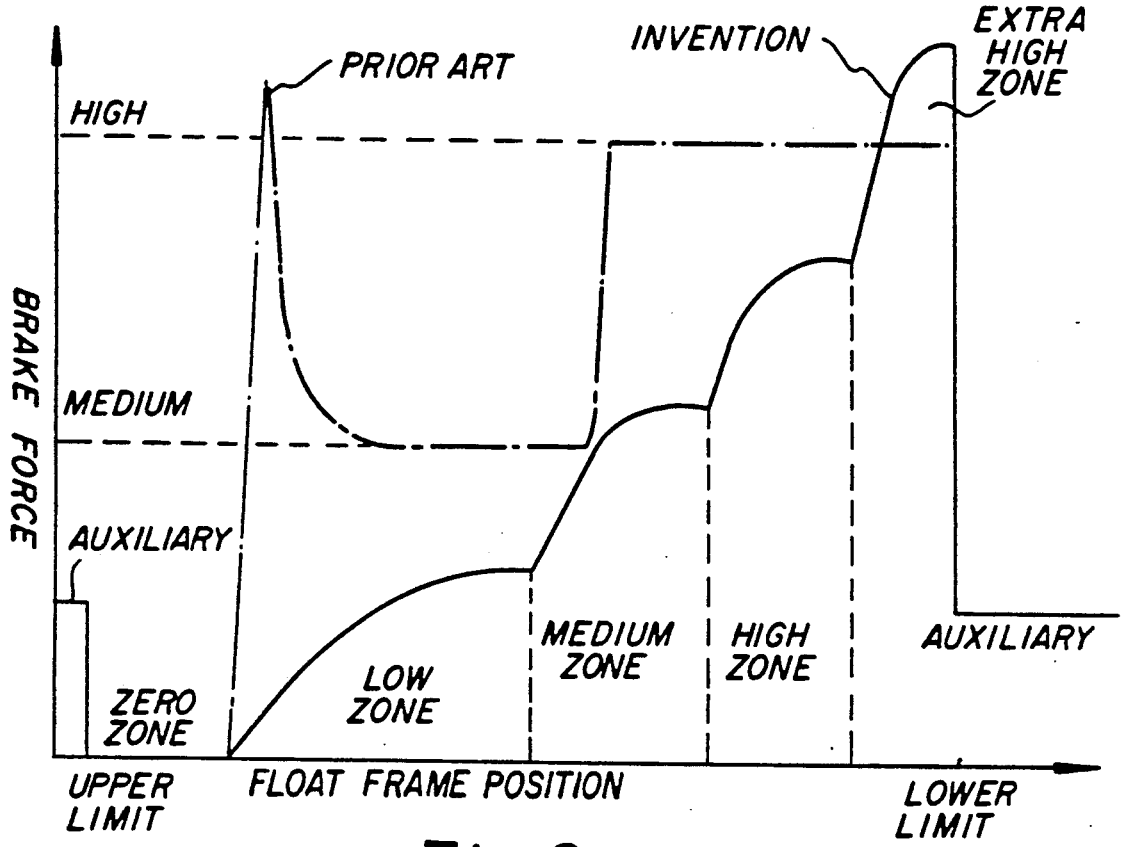
FIG. 2 shows a graph of applied brake force versus float frame position, illustrating certain differences in the modes of operation of the prior art system and the present invention.
Figure 3:
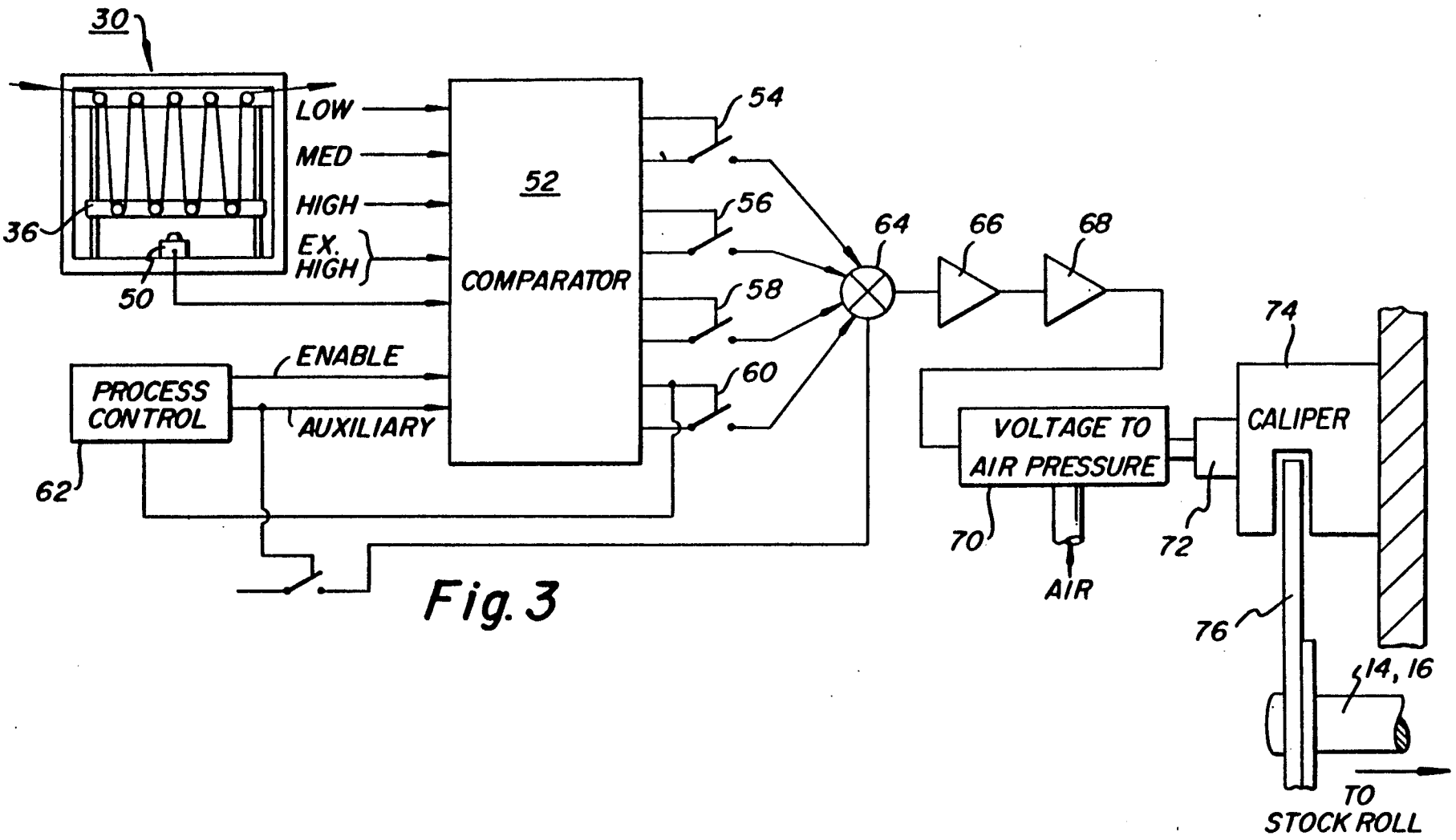
FIG. 3 shows a schematic of the improvements to a system for unwinding a stock roll according to the present invention.

The improvements of the invention are shown in FIGS. 2 to 5. Referring first to FIG. 3, the invention comprises means 50 for sensing the position of support member 36 as it moves relative to frame 32 and for producing a proportional output signal. An ultrasonic detector such as Model PCU made by Agastat Electro Corporation is acceptable for this purpose; however, any convenient sensor may be used within the scope of the invention. The output of sensor 50 is directed to a comparator 52, which may be of the general construction of the comparator used in the system and method of commonly assigned U.S. Pat. No. 4,924,419 with minor changes as described herein.

The overall range of movement of support member 36 is divided into several smaller ranges. In the example illustrates in FIGS. 2 and 3, five ranges have been chosen; however, those skilled in the art will appreciate that the number of ranges and their vertical height may be varied without departing from the scope of the invention. Within the first, uppermost range or zone, the braking force preferably is zero; however, in each successively lower range or zone, the brake force increases gradually until a preselected maximum for that range is reached, as illustrated schematically in the graph of FIG. 2.

Comparator 52 is provided with dial in set points corresponding to the range of values of the signal from sensor 50 as support member 36 moves within the low brake force range or zone, the medium brake force range or zone, the high brake force range or zone or, in unusual circumstances, the extra high brake force range or zone. When support member 36 first enters the low zone, comparator 52 produces an output via contact 54. If support member 36 falls into the medium zone, an additional output is produced via contact 56 which adds to that of the preceding range or zone. Similarly, if control member 36 falls into the high zone, an additional output is produced via contact 58 which adds to that of the preceding two zones. Finally, in the unusual circumstance that control member falls all the way into the extra high zone, still another output is produce via contact 60 which adds to that of the preceding three zones. If desired for process control or monitoring purposes, the output to contact 60 may also be fed back to the overall process control 62. When control member 36 rises relative to frame 32, the control signal for each range or zone is subtracted from the total as control member 36 leaves that zone.

The control signals from contacts 54 to 60 are applied to separate inputs of a summer 64, the remaining input of which comes from process control 62 in the form of an auxiliary signal which also disables comparator 52. Thus, when comparator 52 is disabled, only the auxiliary signal, when selected, passes to summer 64. In some circumstances, such as when a flying splice is to be made of the webs from stock rolls 10,12, comparator 52 will neither be enabled by an enable signal nor disabled by an auxiliary signal from control 62, in which case no signals are applied to summer 64 and the brakes are fully released. The output from summer 64 is directed to an integrator 66 of conventional design, whose integration time constant preferably is selected to be the same for each range of movement of support bar 36 but which may vary from range to range without departing from the scope of the invention. The integrated signal increases until a preselected maximum value is reached, as determined by the magnitude of the signals from contacts 54 to 60 and the characteristics of integrator 66, primarily the time constant of its resistance and capacitance, after which the signal remains essentially constant while support member 36 remains within a given range of movement. The signal from integrator 66 is directed to a driver amplifier 68 of conventional design which is operatively connected to a voltage to pneumatic pressure transducer 70 of conventional design. A transducer such as Model PV1 made by ISI Fluid Power Inc. is acceptable for this purpose. The pneumatic output of transducer 70 is piped through a quick release valve 72 to a pneumatic caliper 74 operatively associated with a brake disk 76 mounted on shaft 14,16 for the stock roll. Valve 72 may be a Model SQEI made by Humphrey Valve Company, which will transmit pneumatic pressure to caliper 74 so long as the pressure remains above a preselected limit of, say, zero psi; but will vent caliper 74 when the transmitted pressure falls below this limit. Caliper 74 may be a Model P10DAR made by Tol-O-Matic, Inc., which includes an internal spring to bias the braking pads away from disk 76 until a certain minimum pressure of, say, 10 psi is applied, after which increases in the applied pressure cause the braking pads to move into contact with the disk with increasing force, thus permitting a very gradual, controllable and soft application of the brakes as a function of the integrated signal received produced by integrator 66.

Figure 4:
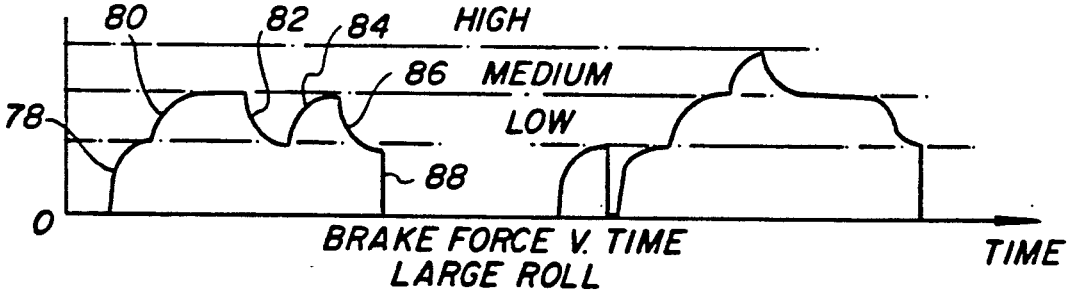
FIG. 4 shows a graph of brake force versus time for the present invention when a large or nearly full stock rol is being unwound.
Figure 5:
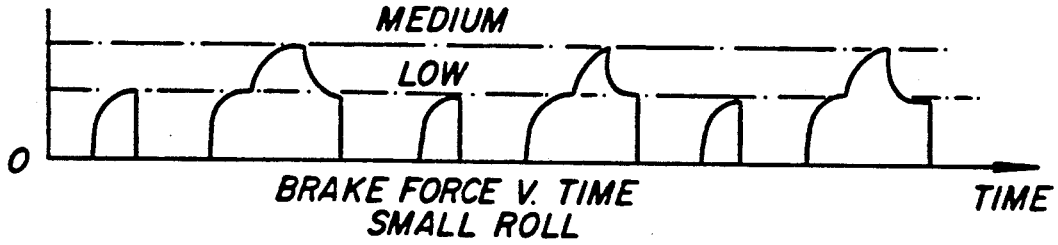
FIG. 5 shows a graph of brake force versus time for the present invention when a small or nearly emptied stock roll is being unwound.

FIGS. 4 and 5 show typical graphs of applied brake force versus time, using the improvements of the invention as shown in FIG. 3, as the demand for the web varies and accumulator means 30 cycles intermittently as the stock roll empties. Starting at the left side of FIG. 4, the brake force is initially zero, which indicates that support member 36 is in the uppermost range of movement. Then, as support member 36 drops, brake force is applied gradually along curve segment 78 until the predetermined maximum for that range of movement is reached. If support member 36 drops further into the medium zone or range, the brake force again increases gradually along curve segment 80 until the predetermined maximum for that range is reached. Later, when support member 36 begins to rise and again enters the low zone or range, the signal from comparator 52 drops and the brake force decreases gradually along curve segment 82 until the predetermined maximum for the low zone is reached again. Later, when support member 36 again falls into the medium zone or range, the signal from comparator 52 rises and the brake force increases gradually along curve segment 84 until the predetermined maximum for that range is reached again. Then, when support member 36 again begins to rise and again enters the low zone or range, the signal from comparator 52 drops and the brake force decreases gradually along curve segment 86 until the predetermined maximum for that range is reached again. Finally, when support member 36 again begins to rise and enters the zero zone or range, the signal from comparator 52 ceases abruptly. As a result, transducer 70 produces a pressure at quick release valve 72 which causes valve 72 to vent caliper 74 so that the brake force drops abruptly to zero along curve segment 88. For example, quick release valve 72 may have a release pressure of zero psi. Depending on factors such as the demand for web material at the subsequent process apparatus, the weight and diameter of the stock roll and the overall storage capacity of means 30, the brake force continues to vary in this general manner, as indicated on the right side of FIG. 4. As the roll becomes smaller, the brake force versus time curves become similar to those shown in FIG. 5, where it is shown that the smaller roll will rotate freely in the zero zone or range more often than the larger one. This is due primarily to the smaller inertia of the smaller roll and the need for higher peripheral roll velocities on a smaller roll to match the demand for web material. Thus, support member 36 assumes a variable, rather than fixed, position at the end of each intermittent cycle of the apparatus which is withdrawing the web; and support member 36 actually may continue to move at the end of each cycle depending on its position within the accumulator. FIG. 2 shows a single curve of brake force as support element 36 falls through its entire range of movement, including the extra high zone or range. When braking in this last range becomes necessary, a signal is fed back to control 62 which produces an auxiliary signal to comparator 52 and summer 64, thus holding the stock roll against further rotation at an auxiliary brake force level, until the cause for entering the extra high zone can be determined and appropriate corrective action taken.

The problems of the prior art system are solved by the present invention. The initially high brake force of the prior art system is eliminated by using precisely controllable pnuematic brakes and by applying the brakes in a gradual fashion. Residual braking force is eliminated by the use of a quick release valve which totally releases the brakes when the support member enters the upper range of its motion. As a result of these improvements, cinching of stock rolls is virtually eliminated.

While my invention has been shown and described with reference to a particular embodiment thereof, those skilled in the art will understand that various modifications in the form and detail of the disclosed apparatus and method may be made without departing from the spirit and scope of my invention.

Having thus described my invention in sufficient detail to enable those skilled in the art to make and use it, I claim as new and desire to secure Letters Patent for:

1. Apparatus for intermittently, cyclically feeding a web of material of indeterminate length, comprising:

a shaft mounted for rotation;

means for mounting a roll of said web material for rotation with said shaft;

means for braking said shaft;

means for receiving a web from said roll and accumulating a variable length of said web, said means for receiving and accumulating comprising: a frame; a first at least one guide roller for said web supported by said frame; a support member; means for permitting said support member to move relative to said frame toward and away from said first guide roller between a minimum brake force zone close to said first guide roller and a maximum brake force zone spaced from said first guide roller; and a second at least one guide roller arranged on said support member, whereby said web can be threaded alternately around said first and second guide rollers as said web passes through said means for receiving and accumulating;

means for intermittently, cyclically withdrawing said web from said means for receiving and accumulating;

means for sensing the position of said support member relative to said frame and producing a signal; and means responsive to said signal (a) for applying said means for braking with sufficient, gradually increasing brake force as said support member moves past each of a plurality of levels away from said first guide roller as demand drops from said means for withdrawing and (b) for releasing said means for braking with sufficient, gradually decreasing brake force as said support member moves past each of said plurality of levels toward said first guide roller as demand increases from said means for withdrawing, wherein said means for applying and releasing applies no break force in a first range of movement of said support member; gradually increases said brake force as said support member moves away from said first guide roller through a second range of movement of said support member until a first preselected maximum brake force is reached; maintains said first preselected maximum brake force for the remainder of said second range; and gradually increases said brake force for the remainder of said second range; and gradually increases said brake force beyond the preselected maximum brake force of the preceding range of movement, as said support member moves away from said first guide roller through successive ranges of movement of said support member until further preselected maximum brake forces are reached and maintained for the remainder of each successive range, to prevent cinching of said web on said roll as said roll accelerates and decelerates during said intermittent, cyclic withdrawing, while said support member assumes a variable position from said minimum brake force zone to said maximum brake force zone at the end of each cycle of said means for withdrawing.

2. Apparatus according to claim 1, wherein said means for applying and releasing gradually decreases said brake force until the preselected maximum brake force of the next range of movement is reached as said support member moves toward said first guide roller from one range of movement to the next range of movement, but reduces said brake force to zero when said support member moves into said first range of movement.

3. Apparatus according to claim 2, wherein said means for braking is pneumatically actuated; and said means for applying and releasing comprises comparator means, operatively connected to said means for sensing, for comparing said signal to preset values corresponding to location of said support member within each of said ranges of movement and for producing control signals of increasing magnitude as said support member moves away from said first guide roller through said ranges of movement; means for integrating said control signal for each range of movement to produce a brake actuation signal; voltage to pressure transducer means for receiving said actuation signal and for directing pneumatic pressure to said means for braking.

4. Apparatus according to claim 3, further comprising means for adding the control signal for each range of movement to the control signal for the preceding ranges of movement to produce a combined control signal for integration by said means for integrating.

5. A method for intermittently, cyclically feeding a web of material of indeterminate length, comprising the steps of:

providing a shaft mounted for rotation;

mounting a roll of said web material for rotation with said shaft;

providing means for braking said shaft;

providing means for receiving a web from said roll and accumulating a variable length of said web, said means for receiving and accumulating comprising: a frame; a first at least one guide roller for said web supported by said frame; a support member; means for permitting said support member to move relative to said frame toward and away from said first guide roller between a minimum brake force zone close to said first guide roller and a maximum brake force zone spaced from said first guide roller; and a second at least one guide roller arranged on said support member, whereby said web can be threaded alternately around said first and second guide rollers as said web passes through said means for receiving and accumulating;

intermittently, cyclically withdrawing said web from said means for receiving and accumulating;

sensing the position of said support member relative to said frame and producing a signal; and (a) applying said means for braking in response to said signal with sufficient, gradually increasing brake force as said support member moves past each of a plurality of levels away from said first guide roller as demand drops during said withdrawing and (b) releasing said means for braking with sufficient, gradually decreasing brake force as said support member moves past each of said plurality of levels toward said first guide roller as demand increases during said withdrawing, wherein said applying step comprises the steps of applying no brake force in a first range of movement of said support member; gradually increasing said brake force as said support member moves away from said first guide roller through a second range of movement of said support member until a first preselected maximum brake force is reached; maintaining said first preselected maximum brake force for the remainder of said second range; and gradually increasing said brake force beyond the preselected maximum brake force of the preceding range of movement, as said support member moves away from said first guide roller through successive ranges of movement of said support member until further preselected maximum brake forces are reached and maintained for the remainder of each successive range, to prevent cinching of said web on said roll as said roll accelerates and decelerates during said intermittent, cyclic withdrawing, while said support member assumes a variable position from said minimum brake force zone to said maximum brake force zone at the end of each cycle of said intermittent withdrawing.

6. A method according to claim 5, wherein said applying step comprises the steps of gradually decreasing said brake force until the preselected maximum brake force of the next range of movement is reached as said support member moves toward said first guide roller from one range of movement to the next range of movement, but reducing said brake force to zero when said support member moves into said first range of movement.

7. A method according to claim 6, wherein said means for braking is pneumatically actuated; and said applying and releasing step comprises the steps of comparing said signal to preset values corresponding to location of said support member within each of said ranges of movement; producing control signals of increasing magnitude as said support member moves away from said first guide roller through said ranges of movement; integrating said control signal for each range of movement to produce a brake actuation signal; and transducing said actuation signal to a pneumatic pressure to actuate said means for braking.

8. A method according to claim 7, further comprising the steps of adding said control signal for each range of movement to said control signal for the preceding ranges of movement to produce a combined control signal for said integrating step.

* * * * *